US010238899B1

(12) United States Patent
Sherman

(10) Patent No.: US 10,238,899 B1
(45) Date of Patent: Mar. 26, 2019

(54) SYSTEMS AND METHODS FOR SUPPORTING AN OPERATOR FROM A BUILDING

(71) Applicant: Hang On Enterprises, Inc., Lynden, WA (US)

(72) Inventor: Bruce Sherman, Lynden, WA (US)

( * ) Notice: Subject to any disclaimer, the term of this patent is extended or adjusted under 35 U.S.C. 154(b) by 0 days.

(21) Appl. No.: 15/445,828

(22) Filed: Feb. 28, 2017

(51) Int. Cl.

| | |
|---|---|
| ***A62B 35/00*** | (2006.01) |
| ***E04G 21/32*** | (2006.01) |
| *E04G 3/34* | (2006.01) |
| *A62B 1/04* | (2006.01) |

(52) U.S. Cl.
CPC ..... *A62B 35/0068* (2013.01); *A62B 35/0043* (2013.01); *E04G 21/3242* (2013.01); *E04G 21/3276* (2013.01); *A62B 1/04* (2013.01); *A62B 35/0006* (2013.01); *E04G 3/34* (2013.01)

(58) Field of Classification Search
CPC ..... A62B 1/00; A62B 1/06; A62B 35/0043; A62B 35/0068; A62B 35/0006; E04G 21/3276; E04G 3/34; E04G 21/3242; B25B 5/101; B25B 5/163; B25B 7/123; B25B 5/12
USPC ..... 248/231.71, 237; 269/228, 249; 182/3, 182/45
See application file for complete search history.

(56) References Cited

U.S. PATENT DOCUMENTS 140,136 A * 6/1873 Holt ..... B25B 1/125 269/208
2,312,583 A * 3/1943 Penlon ..... B66D 3/00 182/11
2,953,174 A * 9/1960 Wilkins ..... B25B 5/12 269/228
3,022,855 A * 2/1962 Lewis ..... A62B 35/0006 182/3
3,620,331 A * 11/1971 Shaw ..... E04G 3/34 182/150
3,863,900 A * 2/1975 Dagiel ..... E04G 21/3233 248/231.71
4,335,873 A * 6/1982 Kiefer ..... B25B 5/163 269/228
4,407,392 A * 10/1983 Lazzari ..... C21C 5/441 182/128
4,496,027 A * 1/1985 Fisher ..... E04G 3/34 182/142
4,627,604 A * 12/1986 Choi ..... B25B 1/125 269/214
4,747,590 A * 5/1988 Yang ..... B25B 5/003 269/249

(Continued)

*Primary Examiner* — Muhammad Ijaz
*Assistant Examiner* — Taylor L Morris
(74) *Attorney, Agent, or Firm* — Michael R. Schacht; Schacht Law Office, Inc.

(57) ABSTRACT

A suspension system for supporting an operator from a parapet of a building has first and second support assemblies adapted to engage the parapet, a first support line extending from the first support assembly to the first operator, and a second support line extending from the second support assembly to the first operator. At least one of the first and second support assemblies engages the parapet to support the operator relative to building. To allow the operator to move relative to the building, the weight of the operator is supported by one of the first and second support assemblies while the other of the first and second support assemblies is moved.

15 Claims, 14 Drawing Sheets

(56) References Cited

U.S. PATENT DOCUMENTS 4,854,016 A * 8/1989 Rice ..... A61G 13/101 24/495
5,036,949 A * 8/1991 Crocker ..... A62B 35/04 182/3
5,050,466 A * 9/1991 Cameron ..... B25B 5/12 81/419
5,065,838 A * 11/1991 Finley ..... E04G 3/34 182/142
5,092,426 A * 3/1992 Rhodes ..... A62B 35/0068 182/3
5,607,029 A * 3/1997 Beckham ..... A62B 35/0068 182/113
5,730,246 A * 3/1998 Beard ..... E04G 3/26 182/45
5,758,743 A * 6/1998 Coyle ..... A62B 35/0068 182/45
6,009,973 A * 1/2000 Woodyard ..... A62B 35/0081 182/36
6,038,829 A * 3/2000 Franks ..... E04G 3/26 52/645
6,092,623 A * 7/2000 Collavino ..... A62B 35/0056 182/3
6,135,300 A * 10/2000 Fox ..... B66C 23/208 182/60
6,382,894 B2 * 5/2002 Goodding ..... E04D 13/158 414/11
6,708,966 B1 * 3/2004 Troudt ..... B25B 5/067 269/249
7,104,166 B1 * 9/2006 Wong ..... B25B 5/12 81/180.1
7,213,805 B2 * 5/2007 Nishimura ..... B25B 5/10 269/228
7,806,232 B2 * 10/2010 Thomas ..... E04G 21/3223 182/113
8,789,655 B2 * 7/2014 Dowie ..... E04G 21/3261 182/234
9,248,323 B1 * 2/2016 Larsen ..... A62B 35/0043
2003/0159882 A1 * 8/2003 Franckewich, Jr. ..... A62B 35/005 182/82
2010/0006373 A1 * 1/2010 Bodnar ..... E04G 21/3214 182/36
2011/0239580 A1 * 10/2011 Rodewald ..... A62B 35/0068 52/699
2012/0186906 A1 * 7/2012 Chilton ..... A62B 1/06 182/3
2014/0374682 A1 * 12/2014 Chilton ..... E04G 5/14 256/68
2015/0157885 A1 * 6/2015 Liu ..... E04G 21/32 182/3
2016/0194890 A1 * 7/2016 Landry ..... E04G 21/3276 248/237
2016/0326757 A1 * 11/2016 West ..... E04G 21/3204
2016/0356050 A1 * 12/2016 Tsaousis ..... E04G 21/3242
2017/0032714 A1 * 2/2017 Barnard, IV ..... G09F 7/20
2017/0203412 A1 * 7/2017 Grobbel ..... B25B 5/12

* cited by examiner

FIG. 4
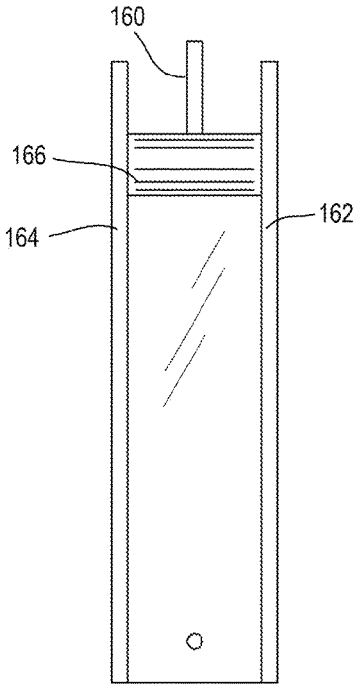
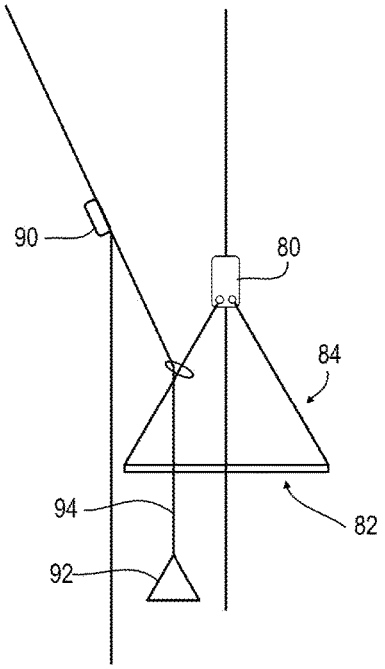
Fig. 1G

SYSTEMS AND METHODS FOR SUPPORTING AN OPERATOR FROM A BUILDING

TECHNICAL FIELD

The present invention relates to systems and methods for supporting an operator from a structure and, more specifically to structure support systems and methods that allow the operator to traverse the exterior of a structure for the purpose of cleaning or maintaining building components in the structure.

BACKGROUND

The maintenance of components of an exterior wall of a structure such as a multi-story building often requires one or more workers to be elevated above the ground. Ladders, scissor lifts, scaffolding, and other ground support systems and methods may be used if access to the exterior wall from the ground is available and/or convenient.

For certain exterior walls, the use of ground support system may not be feasible or otherwise desirable. Accordingly, certain support systems for allowing a worker access to the exterior wall of a structure are supported (e.g., suspended) from the structure itself.

The present invention relates to improved systems and methods for supporting an operator from a structure. The present invention is of particular significance when used to allow a worker to clean the exterior surface of elevated windows of a building, and that example of the present invention will be described herein in further detail. The present invention may, however, be used to allow a worker to perform other tasks related to a structure such as painting, repairing, and the like.

SUMMARY

The present invention may be embodied as a suspension system for supporting an operator from a parapet of a building comprising first and second support assemblies adapted to engage the parapet, a first support line extending from the first support assembly to the first operator, and a second support line extending from the second support assembly to the first operator. At least one of the first and second support assemblies engages the parapet to support the operator relative to building. To allow the operator to move relative to the building, the weight of the operator is supported by one of the first and second support assemblies while the other of the first and second support assemblies is moved.

The present invention may also be embodied as a method of supporting a first operator from a parapet of a building comprising the following steps. First and second support assemblies are provided. First and second support lines are supported from the first and second support assemblies, respectively. The first support assembly is arranged to engage the parapet such that the first operator is suspended from the parapet by the first support assembly through the first support line. The second support assembly is supported relative to the first support assembly at a location spaced from the first support assembly and arranged to engage the parapet. The second support line is engaged to displace the first operator laterally in a desired lateral direction of travel.

The present invention may also be embodied as a support assembly for supporting an operator from a parapet of a building comprising a first portion adapted to engage a front surface of the parapet and a second portion adapted to engage a rear surface of the parapet. At least one of the first portion and the second portion is arranged to engage an upper surface of the parapet. The first portion is arranged to engage the front surface of the parapet. The second portion is displaced relative to the first portion to apply a force against the rear surface of the parapet such that the support assembly is clamped onto the parapet.

BRIEF DESCRIPTION OF THE DRAWINGS

FIG. 1G is a somewhat schematic front elevation view of an example user support system used as part of the example building support system;

FIG. 4 is a front view of one example of a support assembly as shown in FIG. 1;

DETAILED DESCRIPTION

Figure 1A:
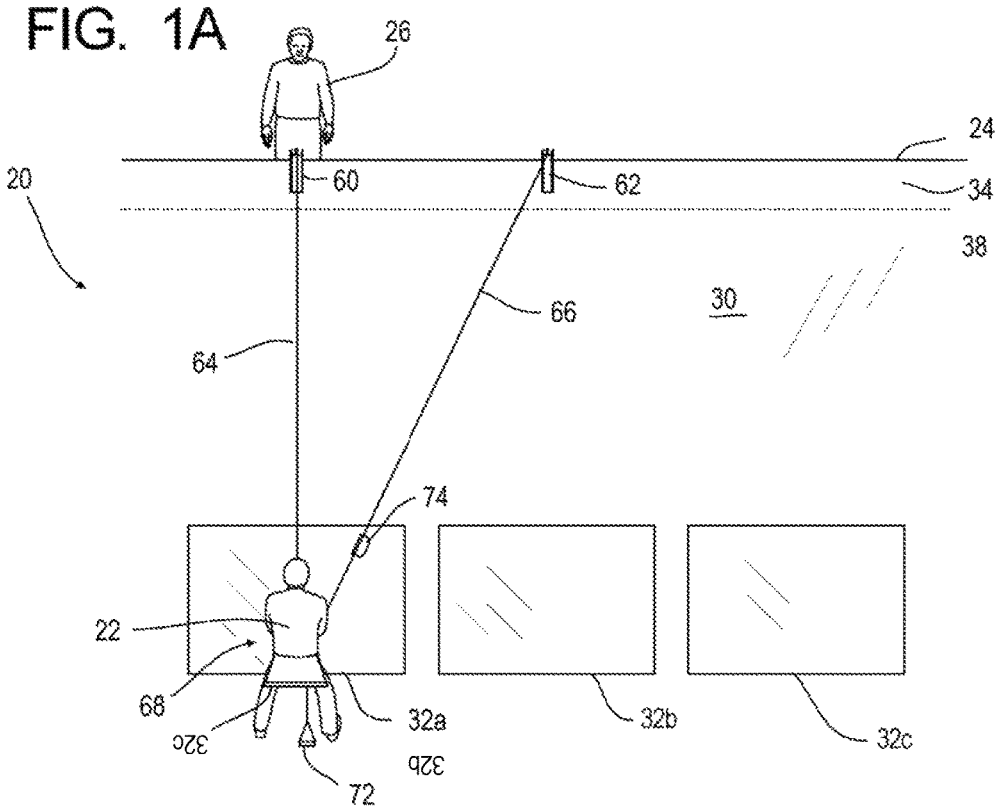
FIG. 1A is a front environmental view of the example building support system in a first operational position.
Figure 1B:
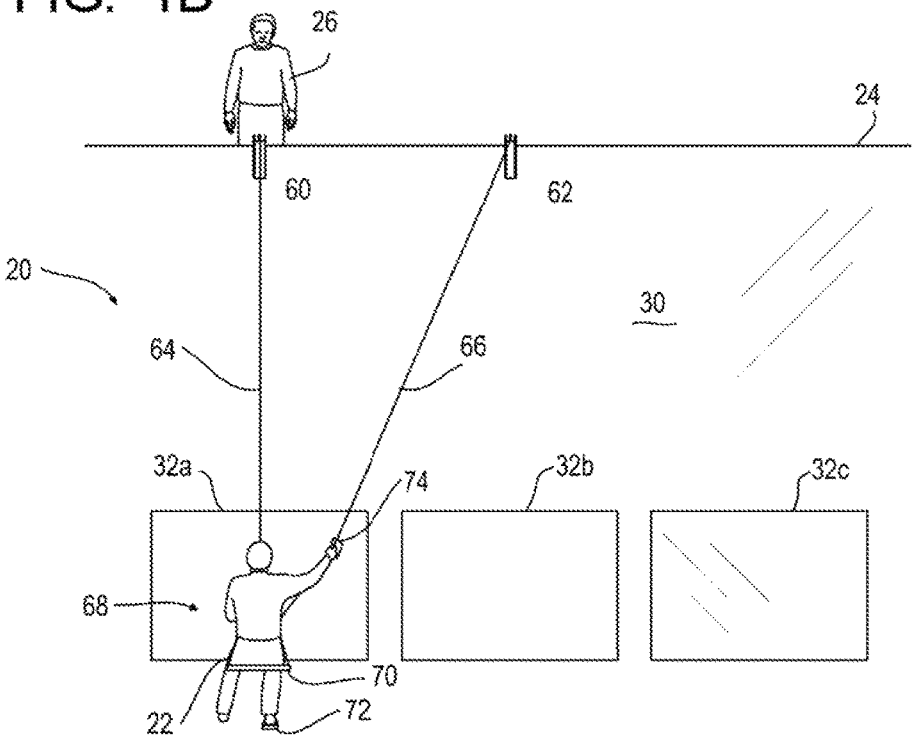
FIG. 1B is a front environmental view of the example building support system as shown in FIG. 1 in a second operational position.
Figure 1C:
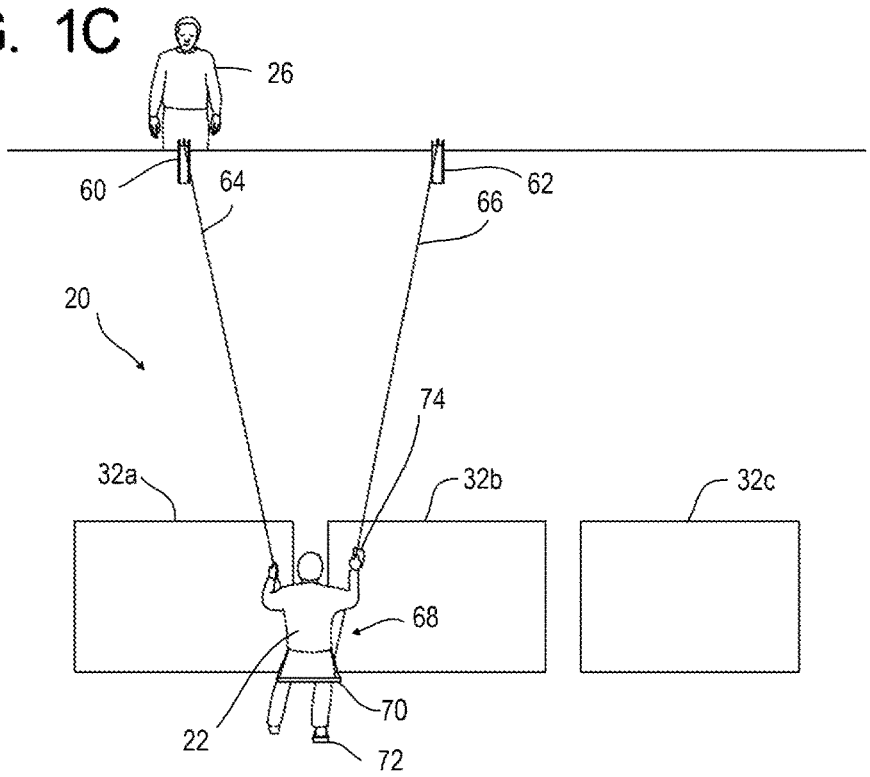
FIG. 1C is a front environmental view of the example building support system as shown in FIG. 1 in a third operational position.

Referring initially to FIGS. 1A-1F of the drawings, depicted therein is a first example building support system 20 (and method of using the first example support system 20) constructed in accordance with, and embodying, the principles of the present invention. The first example support system 20 supports a first operator 22 from a structure 24. A second operator 26 is preferably provided when using the first example support system 20.

Figure 8:
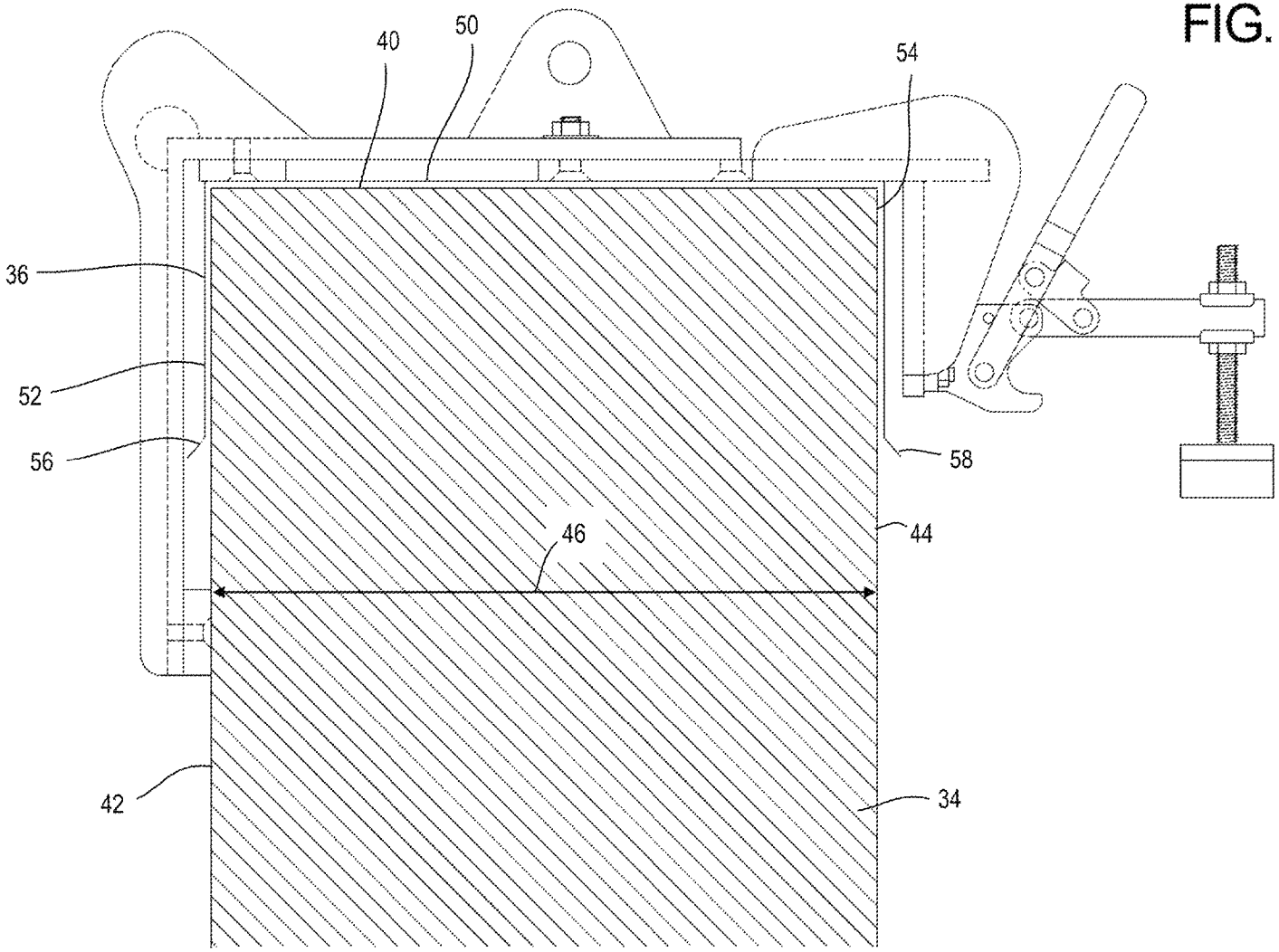
FIG. 8 is a side cutaway view of one example of a support assembly as shown in FIG. 1 resting upon the parapet of a building with a support assembly disengaged.
Figure 9:
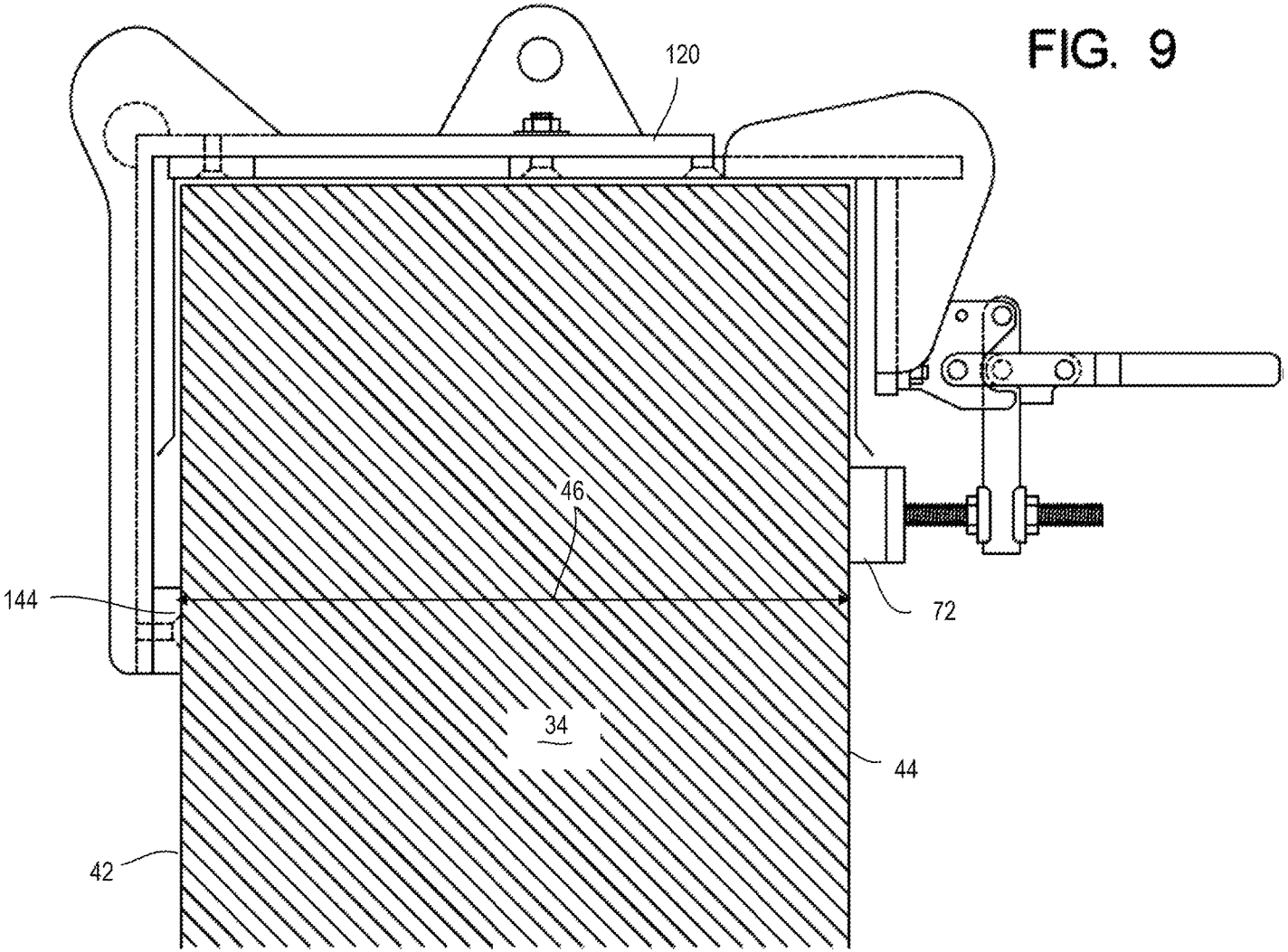
FIG. 9 is a side cutaway view of one example of a support assembly as shown in FIG. 1 resting upon the parapet of a building with a support assembly engaged against the parapet.
Figure 10:
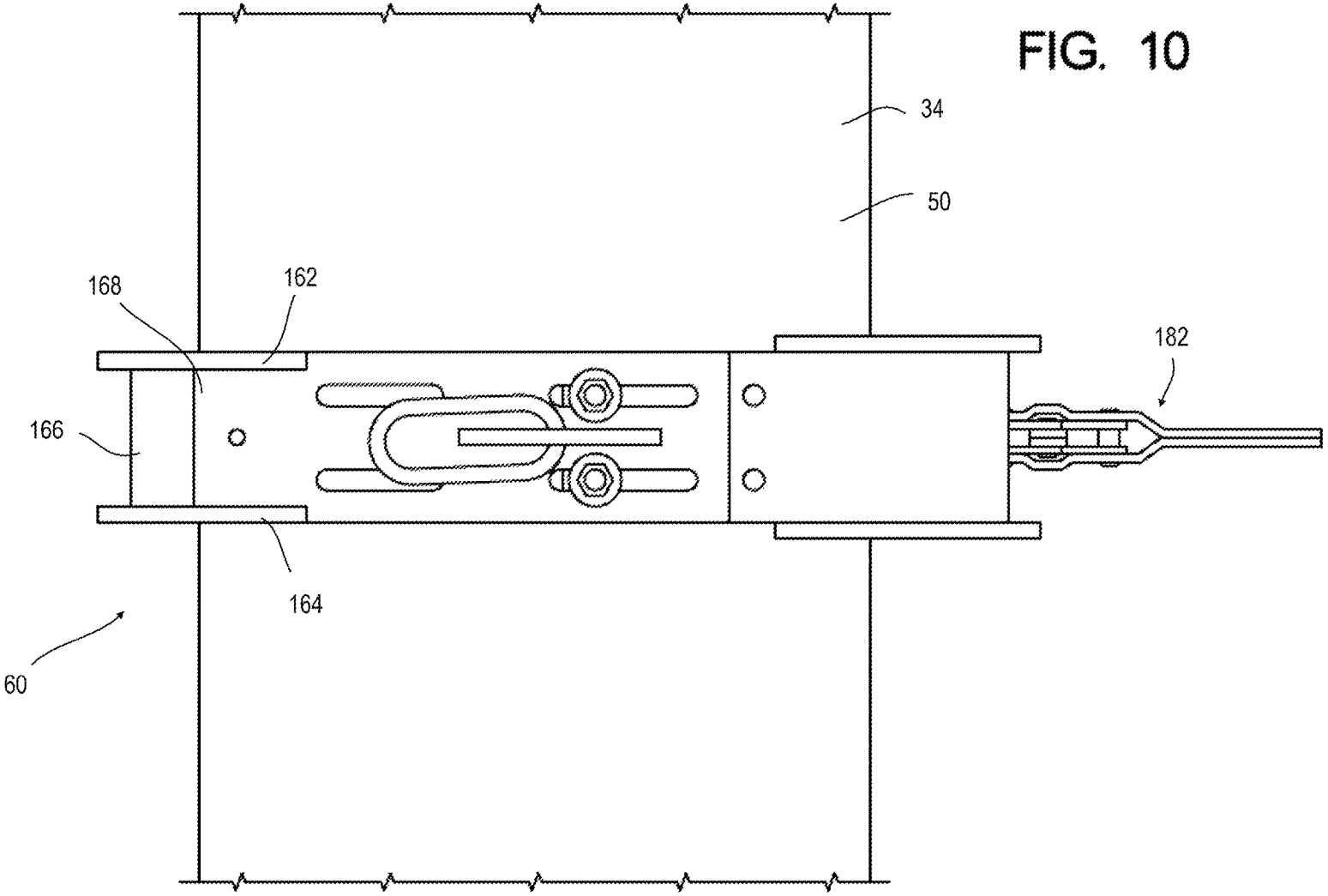
FIG. 10 is a top view of one example of a support assembly as shown in FIG. 1 resting upon the parapet of a building with a support assembly engaged against the parapet; and, FIG. 11 is a top view of the system as shown in FIG. 1 with safety lines connecting each support assembly to a safety cable.

The example structure 24 is or may be conventional and will be described herein only to that extent necessary for a complete understanding of the construction and operation of the first example building support system 20. The example structure 24 is a building that defines an exterior wall 30 in which windows 32 are formed. As is conventional, the exterior wall 30 defines a parapet 34 that extends above a roof 38 of the structure 24. FIGS. 8 and 9 further illustrate that the example parapet 34 supports a flashing 36 and that the example parapet 34 defines an upper surface 40, a front surface 42, a rear surface 44, and a thickness dimension 46 defined by a distance between the front surface 42 and a rear surface 44.

FIGS. 8 and 9 further illustrate that the example flashing 36 defines a flashing upper portion 50, a flashing front portion 52, and a flashing rear portion 54. The flashing front portion 52 defines a flashing front edge 56, while the flashing rear portion defines a flashing rear edge 58. The flashing upper portion 50 substantially conforms to the upper surface 40 of the parapet 34, while the flashing front portion 52 and flashing rear portion 54 extend only partly along the front and rear surfaces 42 and 44, respectively, of the parapet 34. The flashing front edge 56 and flashing rear edge 58 are thus below the upper surface 40 and may be spaced outwardly from the front surface 42 and rear surface 44, respectively.

The example parapet 34 is representative of typical building construction techniques, and the first example building support system 20 is configured to accommodate parapets of different sizes, shapes, and construction. In that context, the example parapet 34 is described herein by way of example only, and the example building support system 20 may be used on parapets having different thickness dimensions, different flashing construction and dimensions, and the like. The term "parapet" is also intended to include building components such as walls, barriers, rails, or the like at the edge of a balcony, roof, bridge, or the like. The first example building support system 20 is adapted to accommodate different parapets and different types of structures 24 as will be apparent from the following discussion.

FIGS. 1A-1F further illustrate that the first example support system 20 comprises a first support assembly 60, a second support assembly 62, a first support line 64, a second support line 66, and a user support system 68. The example user support system 68 may comprise a first user support 70 and a second user support 72. The example first user support 70 is a seat assembly, and the example second user support 72 is a foot line assembly. Optionally, one or both of the first and second user supports 70 and 72 may take the form of a working platform or a man lift. The example user support system 68 further comprises a D-ring that facilitates grasping of the second support line 66 by the first operator 22.

The example user support system 68 further comprises rope, cable, and/or hardware such as sliding couplings, shackles, carabiners, assisted braking belay device, ascender, or the like capable of performing the functionality as described herein. In particular, the first and second user support lines 64 and 66 are not secured together at the user support system 68 but are supported adjacent to each other for relative movement by the first and second operators 22 and 26 described herein. In addition, the first and second support lines 64 and 66 each define an effective length between the first and second support assemblies 60 and 62 and the user support system 68, respectively. The example user support system 68 is configured such that the first operator 22 alters the effective lengths of the first and second support lines 64 and 66 during use of the first example building support system 20.

FIG. 1G is a somewhat schematic depiction of an example first user support system 70 and second user support system 72 that may be used to form the example user support system 68. The example first user support system 70 comprises a descender or assisted braking belay device 80, a seat assembly 82, and a seat rigging 84 configured to support the seat assembly 82 from the descender 80. The example second user support system 72 comprises an ascender 90, a foot loop 92, and a foot strap 94 configured to support the foot loop 92 from the ascender 90.

The descender 80 allows the first operator 22 to set the elevation of the seat assembly 82 at or near the desired work level. The ascender 90 allows the first operator to raise and lower the level of the foot loop 92 relative to the second support line 66. The ability to move the foot loop 92 relative to the second support line 66 simplifies the process of swinging the user support system 68 laterally relative to the structure 24 as will be described in further detail below.

The example first and second support assemblies 60 and 62 are adapted to engage the parapet 34 as will be described in further detail below. The example first support lines 64 extends between the first support assembly 60 and the first user support 70 of the user support system 68. The example second support line 66 extends between the support assemblies 62 and the second user support 72 of the user support system 68.

In use, the first support assembly 60 is supported on the parapet 34 at a first primary support location above a first desired window 32*a* to be washed. Next, the first operator 22 rappels down the exterior wall 30 by playing out a first primary length of the first support line 64 until the first user support 70 is supported at a first desired work location at a first desired work level defined by the vertical elevation of first window 32*a*. The first user support 70 is configured to releasably hold the first support line 64 in the first primary length. The second support assembly 62 is initially supported by the parapet 34 at a first secondary location spaced from the first primary location, and the second support line 66 defines a first secondary length. The second user support 72 is configured to releasably hold the second support line 66 in the first secondary length. At this point, the first operator 22 sits on the first user support 70 and washes the first window 32*a*.

Figure 1D:
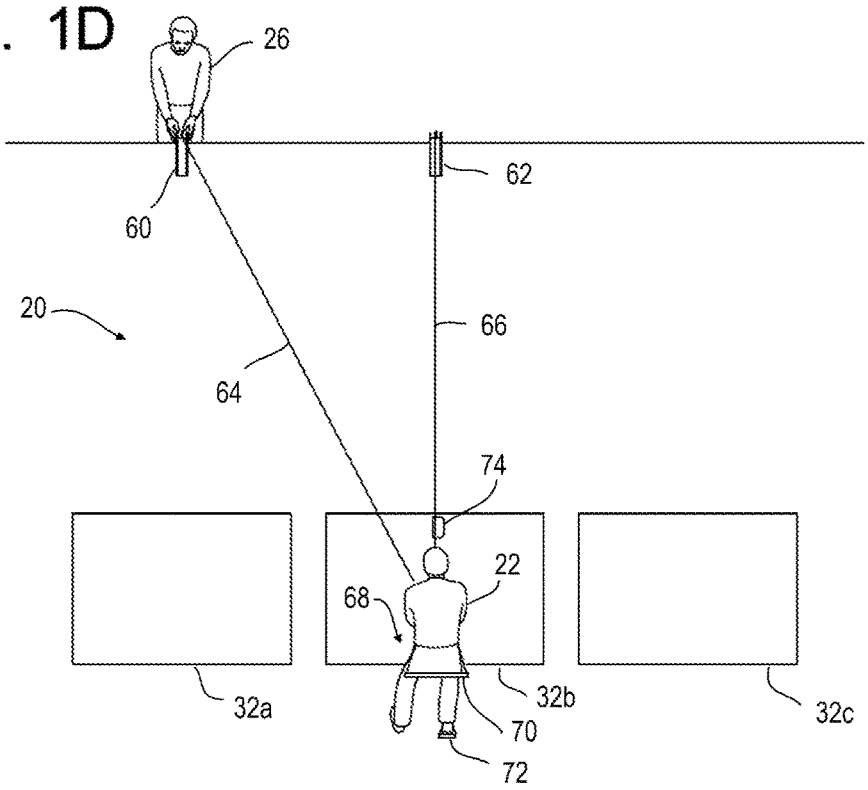
FIG. 1D is a front environmental view of the example building support system as shown in FIG. 1 in a fourth operational position.

When the first window 32*a* is washed, the first operator 22 transfers the first operator's weight to the second user support 72 such that the first operator's weight is supported by the second support line 66 and is removed from the first user support 70 and first support line 64. By this action, the first operator 22 takes up slack in the second support line 66 to define a second secondary length as shown by a comparison of FIGS. 1B, 1C, and 1D. As the slack in the second support line 66 is taken up, the first operator 22 is displaced in a first direction of travel from the first desired work location to a second desired work location adjacent to a second desired window 32*b* to be washed as shown in FIG. 1D. The first operator 22 may grasp and operate the ascender 90 as described above to assist in moving to the second desired work location.

At this point, with the first operator's weight removed from the first user support 70, the first user support line 64 is slack. Removing the first operator's weight from the first user support 70 provides enough slack on the first support line 64 to allow the first operator 22 to move from the first desired location to the second desired location without increasing the effective length of the first support line 64. For larger distances, the effective length of the first support line 64 may be increased and an effective length of the second support line 66 may be decreased while the first operator 22 moves from the first desired location to the second desired location.

Figure 1E:
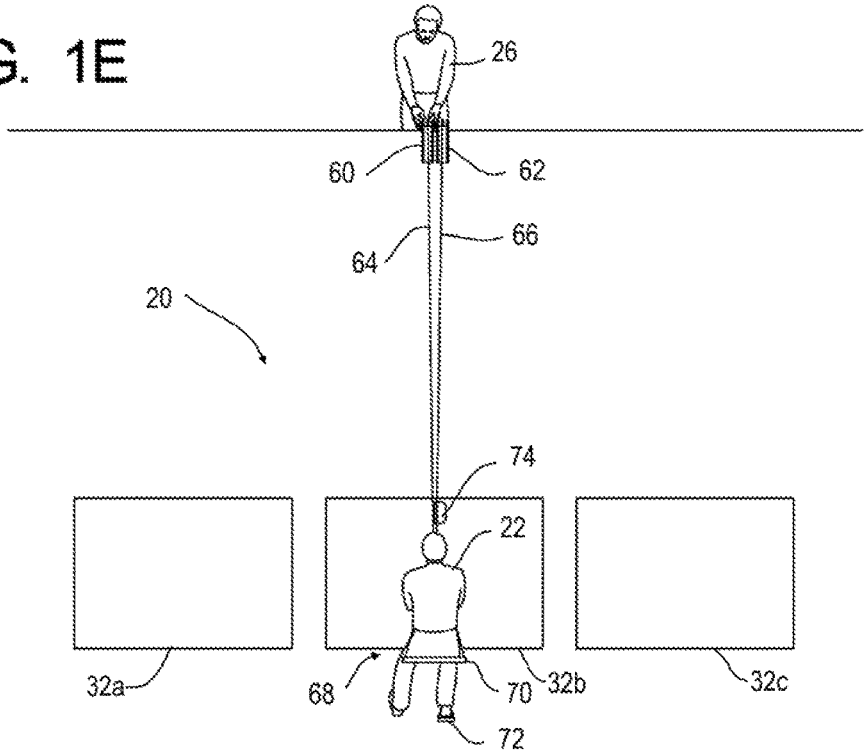
FIG. 1E is a front environmental view of the example building support system as shown in FIG. 1 in a fifth operational position.
Figure 1F:
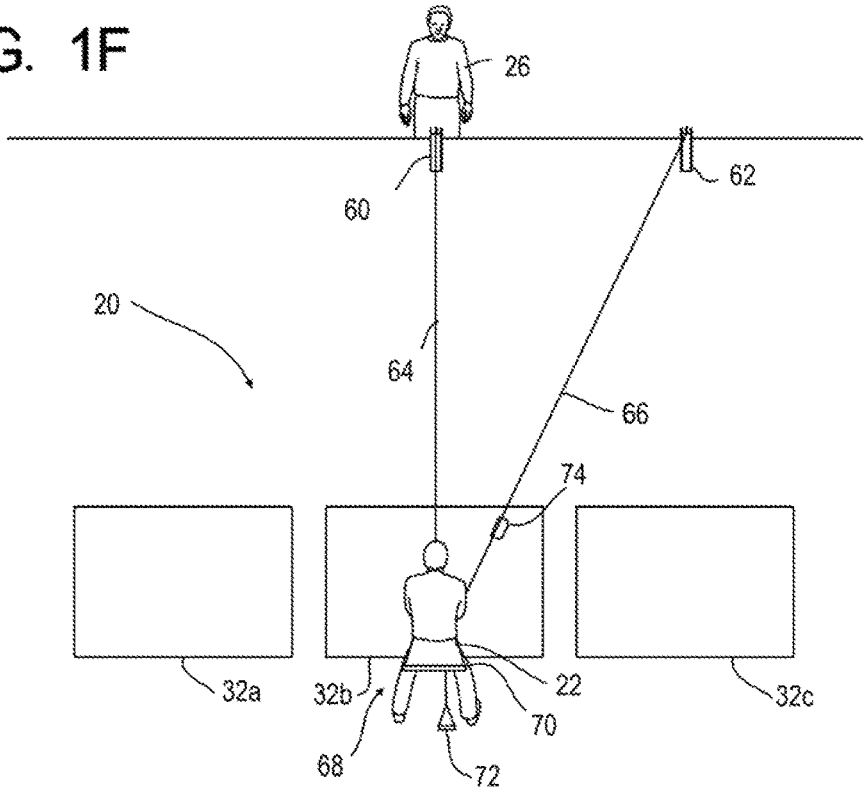
FIG. 1F is a front environmental view of the example building support system as shown in FIG. 1 in a sixth operational position.
Figure 2:
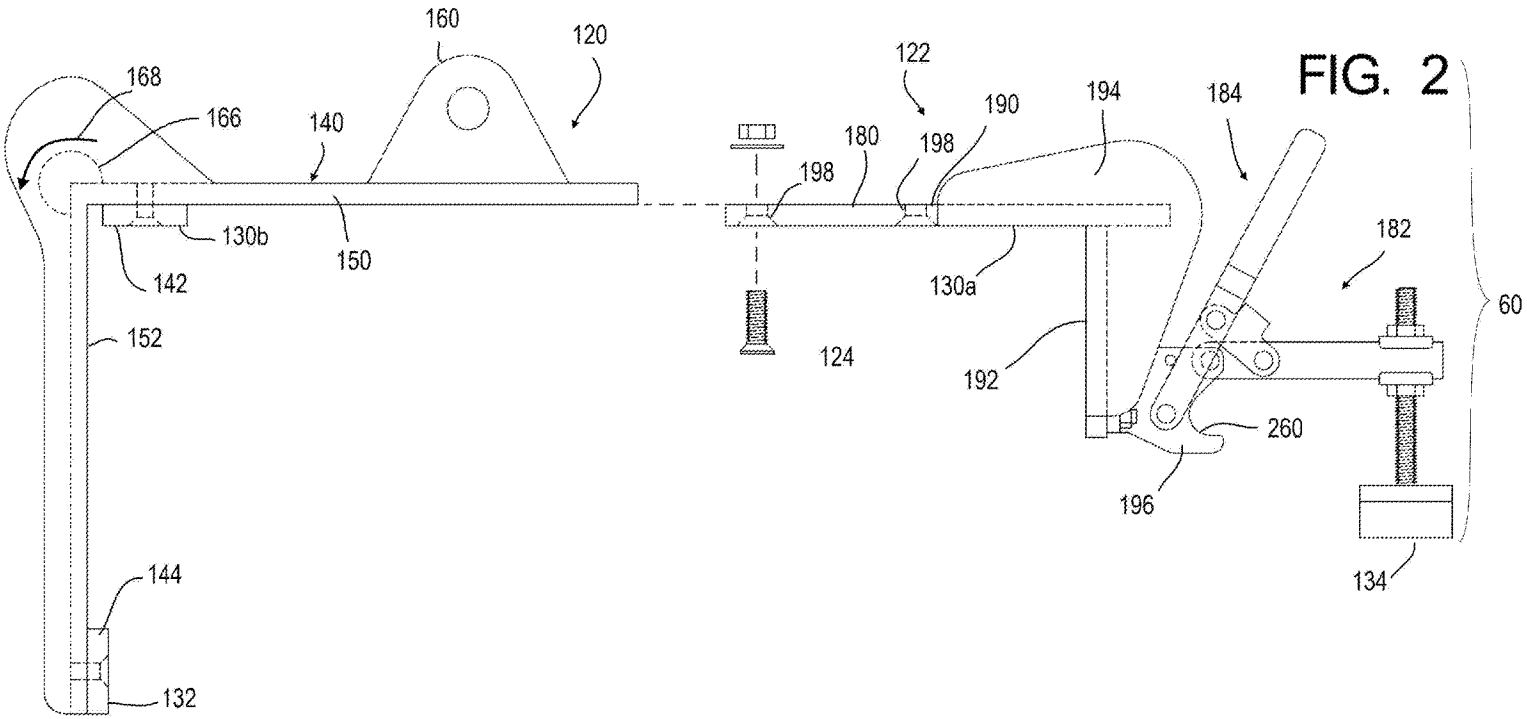
FIG. 2 is a side cutaway view of one example of a support assembly as shown in FIG. 1 unassembled and disengaged.
Figure 3:
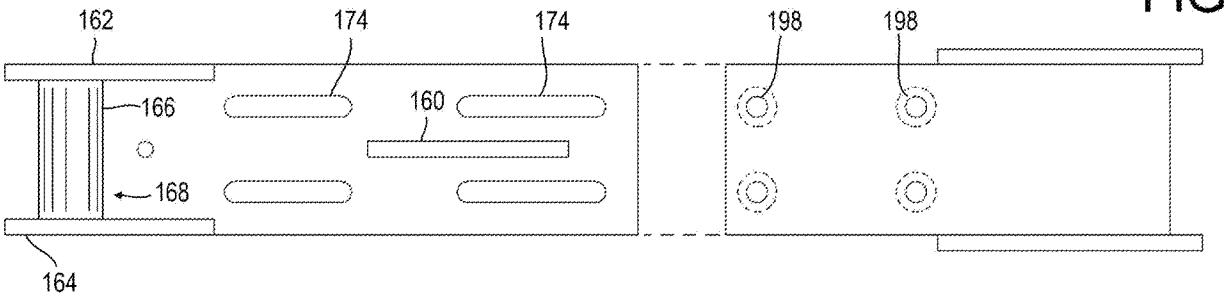
FIG. 3 is a top view of one example of a support assembly as shown in FIG. 1 unassembled.

With the weight of the first operator 22 still supported by the second user support 72, the second operator 26 may then displace the first support assembly 60 from the first primary support location to a second primary support location adjacent to the first secondary support location as shown in FIG. 1E. At this point, the first operator 22 transfers the first operator's weight back to the first user support 70 and washes the second window 32*b*. With the first operator's weight now supported by the first user support 70 and not the second user support 72, the second operator 26 may move the second support assembly 62 to a second secondary location spaced from the second primary location in preparation for the next move from the second window 32*b* to a third window 32*c*. The second operator 26 may lengthen the second support line 66 if necessary to move the second support assembly 62.

When an entire row of the windows 32 is washed, the first operator 22 may move to another row above or below (typically below) the initial row by playing out a second primary length of the first support line 64 until the first user support 70 is supported at a second desired work level defined by the vertical elevation of second row of windows. The operators 22 and 26 may also change the direction of travel by reversing the process described above to move back along the structure 24. Repositioning the second support assembly 62 from one side to the other side of the first support assembly 60 may facilitate the changing of the direction of travel relative to the structure 24 but is not necessary.

In the example depicted in FIGS. 1A-1F, the first support assembly 60 is always on the left and the second support assembly 62 is always on the right while traversing the first row of windows 32*a*, 32*b*, and 32*c*. To wash a second row of windows after washing the windows 32*a*, 32*b*, and 32*c* in the first row, the example first operator 22 may then rappel down to the second row of windows and move back in the other direction. As generally described above, the example second operator 26 may switch the second support assembly 62 to the left side of the first support assembly 60 as the operators 22 and 26 move back in a second direction of travel opposite the first direction of travel.

The example first and second support lines 64 and 66 are secured at an upper end to the example first and second support assemblies 60 and 62, respectively. The example first support line 64 is connected to the first user support 70 by hardware capable of allowing the first operator to alter an effective length of the first support line 64 and to fix the effective length of the first support line 64 at a desired effective length. The example second support line 66 is connected to the foot line 72 by hardware capable of allowing the first operator to alter an effective length of the second support line 66 and to fix the effective length of the first support line 64 at a desired effective length. The hardware and configurations used to connect the first and second support lines 64 and 66 to the first and second support assemblies 60 and 62 and to the first user support 70 and the second user support 72, respectively, are or may be conventional and need not be described herein in detail.

Turning now to FIGS. 2-10, the construction and operation of the example first and second support assemblies 60 and 62 will now be described. The example support assemblies 60 and 62 are, but need not be, identical. Given that the example first and second support assemblies 60 and 62 are identical, only the first example support assembly 60 will be described herein in detail in the interests of brevity.

The example first support assembly 60 comprises a first frame assembly 120, a second frame assembly 122, and one or more connecting bolt assemblies 124. At least one upper engaging surface 130 is formed on one or both of the first and second frame assemblies 120 and 122 and is configured to engage the flashing upper portion 50 such that downward loads on the example support assembly 60 are transferred to the upper surface 40 of the parapet 34. At least one first stabilizing surface 132 is defined by the example first frame assembly 120 and at least one second stabilizing surface 134 is defined by the example second frame assembly 122. The first and second stabilizing surfaces 132 and 134 oppose each other and, during normal use of the example support assembly 60, engage the front and rear surfaces 42 and 44, respectively, of the parapet 34.

In addition, the first and second frame assemblies 120 and 122 are adjustable to allow a distance between the first and second stabilizing surfaces 132 and 134 to be altered to conform to the thickness dimension 46 defined by the parapet 34. The example support assembly 60 thus can be adjusted to accommodate parapets having different thickness dimensions.

The example first frame assembly 120 comprises a frame member 140, a bearing member 142, and a first stabilizing member 144. The example bearing member 142 defines a first upper engaging surface 130*b*. In one example, each of the bearing member 142 and the first stabilizing member 144 is a removable component that is compressible and has a low coefficient of friction. In addition, the bearing member 142 and the first stabilizing member 144 are removably attached (e.g., by screws) to allow replacement when worn. The bearing member 142 and first stabilizing member 144 are may also be removably attached to increase the spacing distance between the example frame member 140 and the surface of the parapet 34 and thereby avoid contacting delicate parapet features such as the flashing front edge 56. As an example of a delicate parapet feature to be avoided, the flashing front edge 56 is designed to drip water away from the parapet front surface 42. The flashing front edge 56 is not structural and can be easily bent such that the aesthetic and functional properties of the parapet 34 are adversely affected.

The example stabilizing member 144 defines the example first stabilizing surface 132. The example frame member 140 comprises an upper first frame portion 150 and a lower first frame portion 152. An anchor flange 160 extends from the first frame portion 150. First and second guide flanges 162 and 164 extend from a juncture of the upper first frame portion 150 and the lower first frame portion 152. A guide surface 166 extends between the guide flanges 162 and 164. A guide channel 168 is defined between the guide flanges 162 and 164 and over the guide surface 166. First and second pairs of slots 174 are formed in the example upper first frame portion 150.

The example second frame assembly 122 comprises a frame member 180, an engaging assembly 182, and a lever assembly 184. Operation of the lever assembly 184 reconfigures the engaging assembly 182 between an unclamped configuration (FIG. 8) and a clamped configuration (FIG. 9) as will be described in further detail below.

The example frame member 180 comprises an upper second frame portion 190 and a lower second frame portion 192. The example upper second frame portion 190 defines a second upper engaging surface 130*a*. At least one brace flange 194 extends from a juncture of the upper second frame portion 190 and the lower second frame portion 192. A support flange 196 extends from the lower second frame portion 192. First and second sets of holes 198 are formed in the upper second frame portion 190.

The example engaging assembly 182 comprises an engaging support 220, an engaging rod 222, and a second stabilizing member 224. The example engaging support 220 is pivotably supported by the support flange 196. The example engaging rod 222 threadingly engages the engaging support 220. The example second stabilizing member 224 is mounted on one end of the engaging rod 222 and defines the example second stabilizing surface 134.

In one example, the second stabilizing member 224 is a removable component having a low coefficient of friction, removably attached to engaging rod 222.

Figure 5:
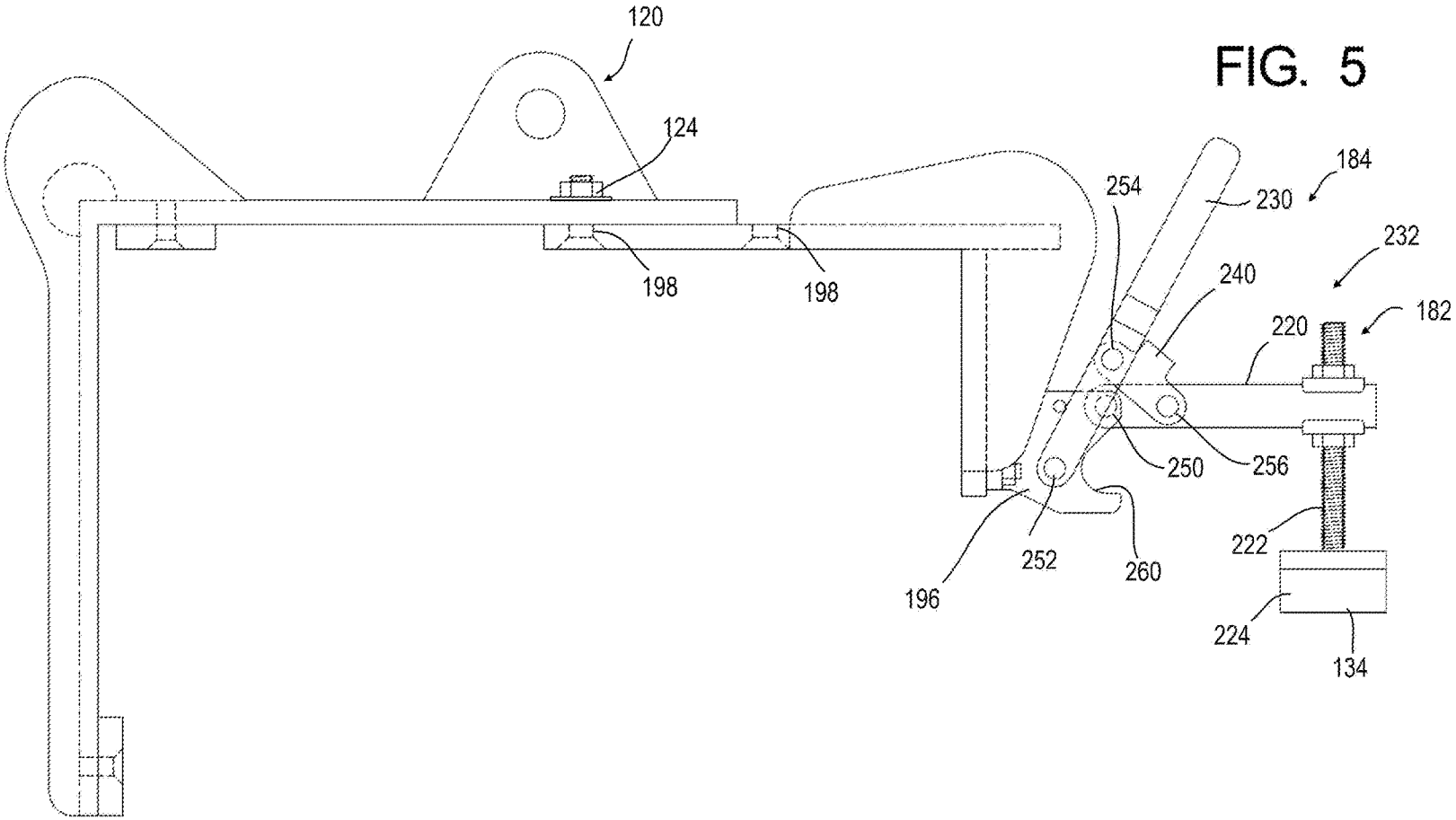
FIG. 5 is a side cutaway view of one example of a support assembly as shown in FIG. 1 assembled and disengaged.
Figure 6A:
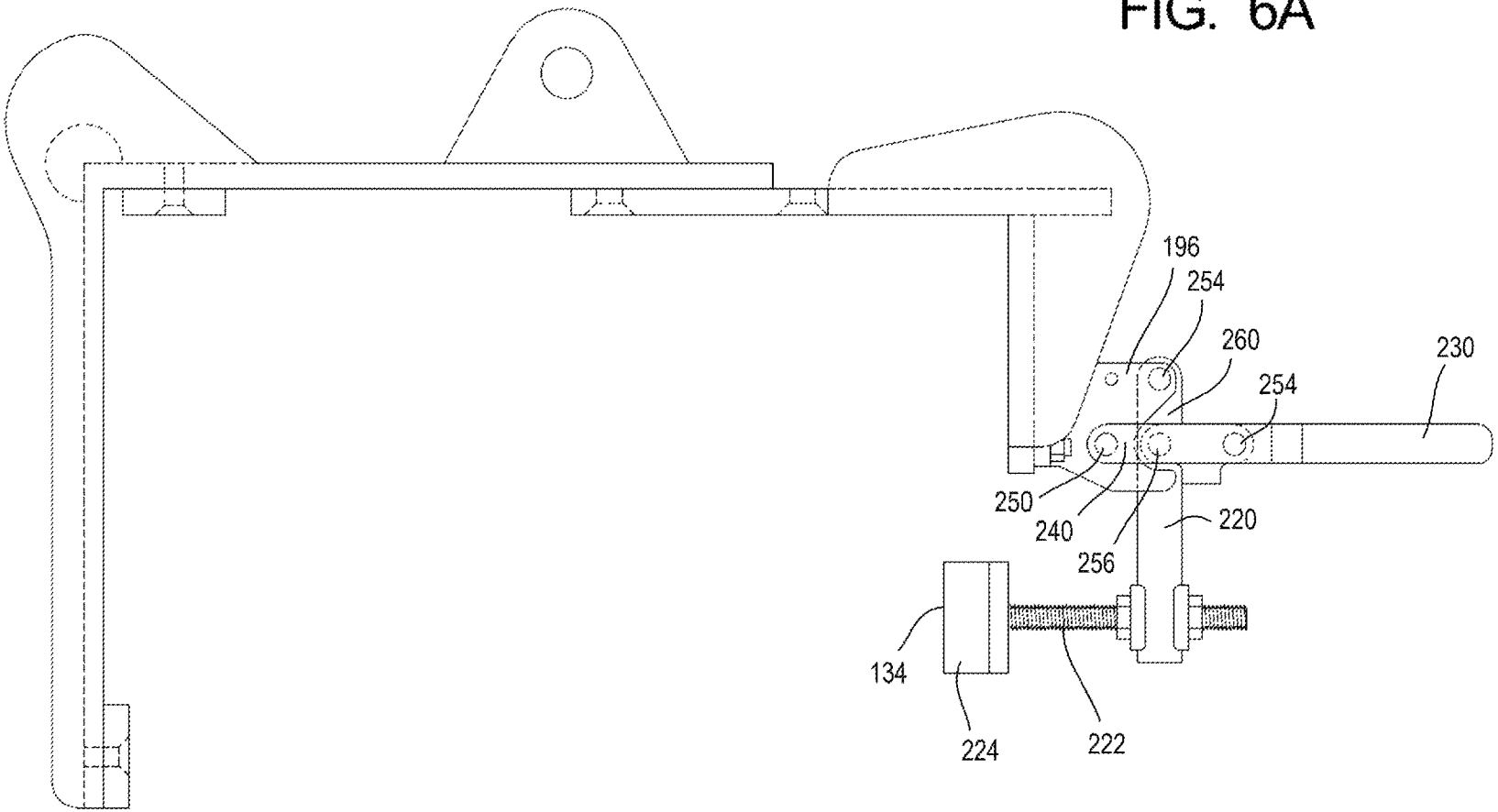
FIG. 6A is a side cutaway view of one example of a support assembly as shown in FIG. 1 unassembled and engaged.
Figure 6B:
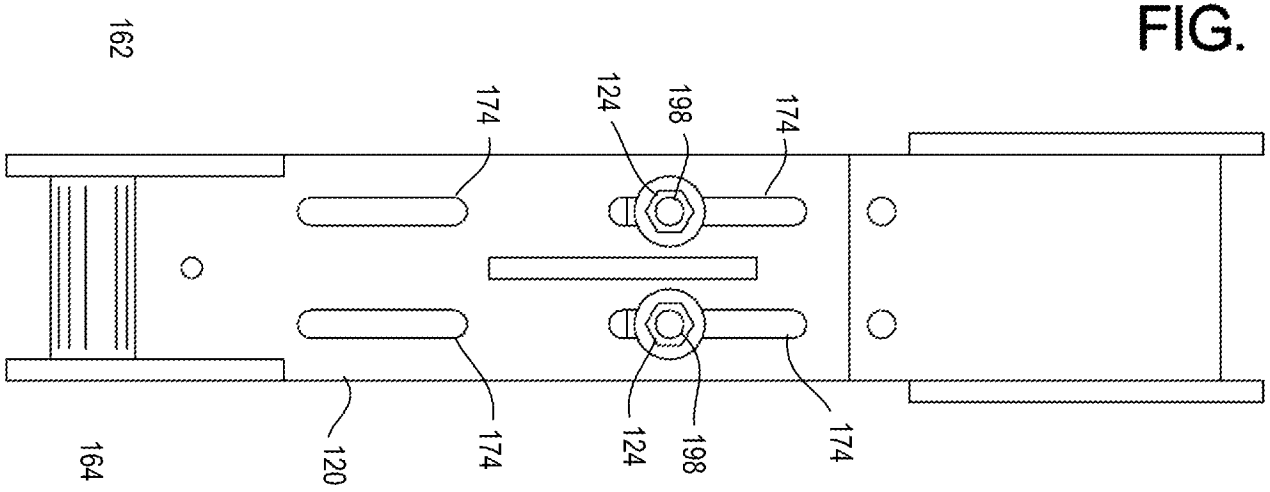
FIG. 6B is a top view of the example shown in FIG. 6A.
Figure 7A:
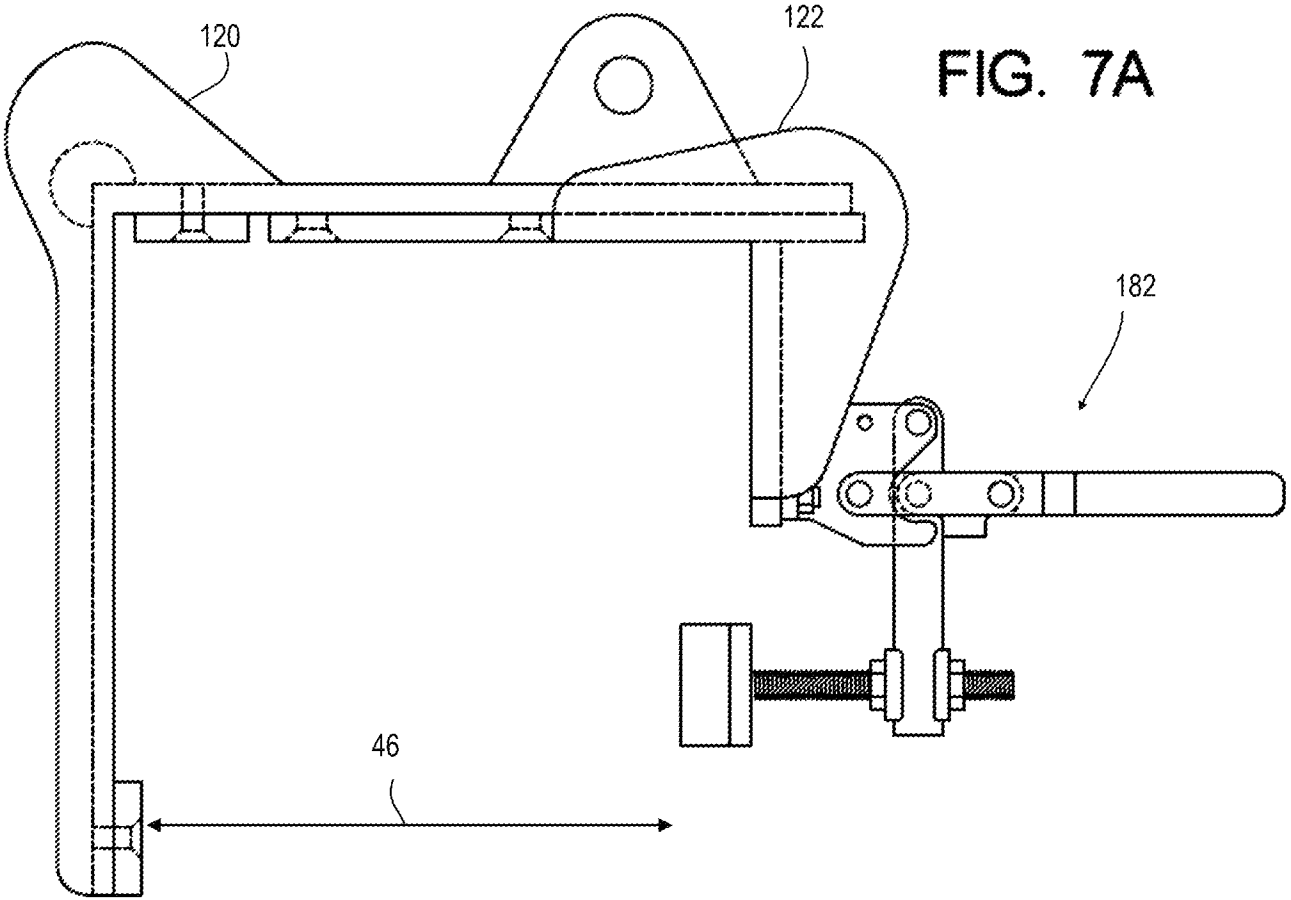
FIG. 7A is a side view of the device shown in FIG. 6A assembled for a longitudinally narrower parapet.
Figure 7B:
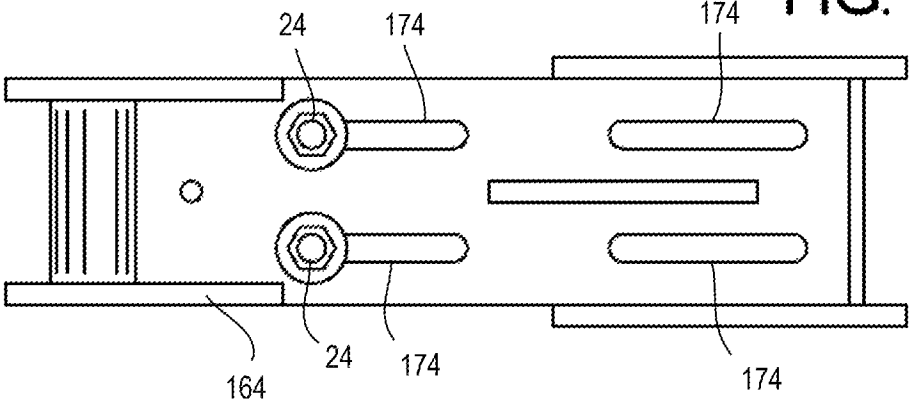
FIG. 7B is a top view of one example of a support assembly as shown in FIG. 1.

The example lever assembly 184 comprises a lever member 230 and a linkage assembly 232. The example lever member 230 is pivotably supported by the support flange 196. The example linkage assembly 232 is operatively connected between the engaging support 220 and the lever member 230 such that rotation of the lever member 230 between an unclamped position as shown in FIG. 5 and a clamped position as shown in FIG. 6 displaces the engaging support 220 such that the engaging rod 222 moves from an unclamped position into a clamped position. As further shown by a comparison of FIGS. 8 and 9, when the engaging rod 222 is in the unclamped position, the second stabilizing member 224 is spaced from the rear surface 44 of the parapet 34, and when the engaging rod 222 is in the clamped position, the second stabilizing member 224 is arranged such that the second stabilizing surface 134 engages the rear surface 44 of the parapet 34.

The example linkage assembly 232 comprises a link member 240 operatively connected between the engaging support 220 and the lever member 230 such that rotation of the lever member 230 causes rotation of the engaging support 220. In particular, the engaging support 220 is pivotably connected to the support flange 196 by a first pivot member 250. The lever member 230 is pivotably connected to the support flange 196 at a second pivot member 252. The link member 240 is operatively connected to the engaging support 220 by a third pivot member 254 and to the lever member 230 by a fourth pivot member 256.

The pivot members 250, 252, 254, and 256 are offset from each other such that rotation of the lever member 230 from a disengaged position through an angle of approximately 75 degrees to an engaged position causes the engaging support 220 to rotate through an angle of approximately 90 degrees. As the lever member 230 moves from the disengaged position to the engaged position, the engaging support 220.

The fourth pivot member 256 is arranged within a stop notch 260 defined by the support flange 196 when the lever member 230 is in the engaged position. When the fourth pivot member 256 is within the stop notch 260, the linkage assembly 232 is an over-the-center linkage that inhibits movement of the lever member 230 from the engaged position to the disengaged position. However, the application of deliberate manual force to displace of the lever member 230 from the engaged position to the disengaged position allows the engaging support 220 to be moved such that the engaging rod 222 moves from the clamped position back to the unclamped position.

Further, the connecting bolt assemblies 124 may be used to secure the first and second frame assemblies 120 and 122 together in a manner that allows gross adjustment of the distance between the first and second stabilizing surfaces 132 and 134. In particular, the first and second frame assemblies 120 and 122 are arranged such that one or both of the first and second sets of holes 198 are aligned with one or both of the first and second slots 174 and the distance between the first and second stabilizing surfaces 132 and 134 is at a desired distance. Then, at least one of the connecting bolt assemblies 124 is inserted through the aligned slots 174 and holes 198 and tightened to rigidly connect the first and second frame assemblies 120 and 122 together.

The position of the engaging rod 222 relative to the engaging support 220 may also be altered to allow fine adjustment of the distance between the first and second stabilizing surfaces 132 and 134 when the engaging rod 222 is in the engaged position. In particular, axial rotation of the engaging rod 222 moves a position of the second stabilizing surface 134 relative to the engaging support 220. Lock nuts may be used to lock the engaging rod 222 in a desired position relative to the engaging support 220.

Figure 11:
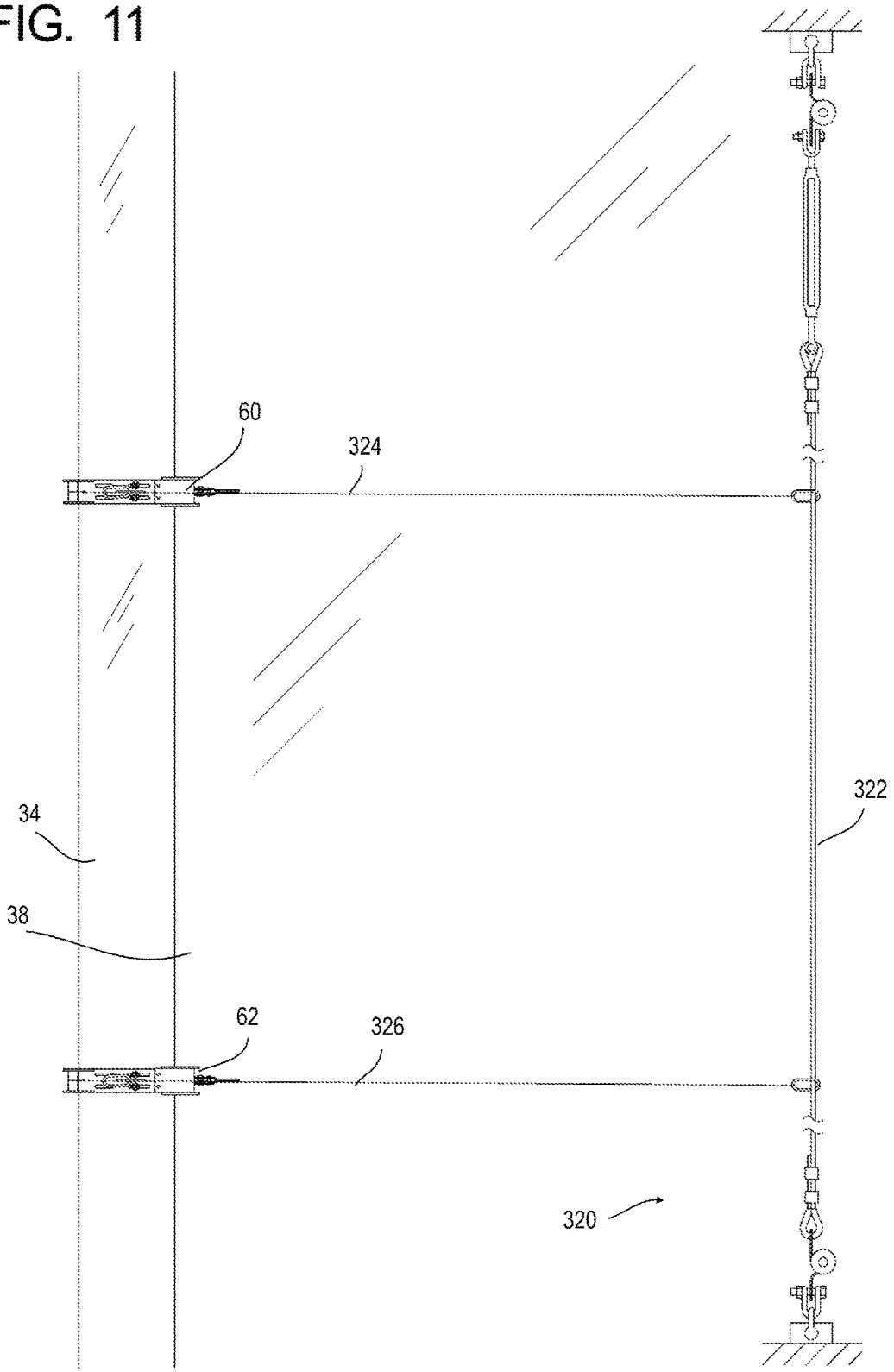

Referring now to FIG. 11 of the drawing, depicted therein is a safety cable system 320. The safety cable system 320 comprising a safety cable 322 and first and second safety lines 324 and 326 extending between the safety cable 322 and the first and second support assemblies 60 and 62 and/or the first and second support lines 64 and 66, respectively. The example safety system 320 is or may be conventional and will not be described herein in further detail.

What is claimed is:

1. A suspension system for supporting an operator from a parapet of a building adjacent to an exterior wall of the building, the parapet defining an upper surface, a front surface adjacent to the exterior wall of the building, and a rear surface, the suspension system comprising:

first and second support assemblies adapted to engage the parapet, where each of the support assemblies comprises a first frame assembly defining a first stabilizing surface, and a second frame assembly defining a second stabilizing surface and comprising a lever assembly operable to place the second frame assembly in clamped and unclamped configurations, the first frame assembly is releasably securable relative to the second frame assembly to allow a gross distance between the first and second stabilizing surfaces to be adjusted, as the lever assembly is moved into the clamped configuration, the lever assembly displaces the second stabilizing surface towards the first stabilizing surface, and as the lever assembly is moved into the unclamped configuration, the lever assembly displaces the second stabilizing surface away from the first stabilizing surface;

an operator engaging member configured to support the operator;

a first support line extending from the first support assembly to the operator engaging member; and a second support line extending from the second support assembly to the operator engaging member; wherein the first frame assemblies of the first and second support assemblies are releasably secured to the second frame assemblies of the first and second support assemblies, respectively, such that the gross distance between the associated first and second stabilizing surfaces is a desired distance determined based on a thickness dimension of the parapet between the front surface and the rear surface of the parapet;

with the gross distance adjusted to the desired distance, the lever assemblies of the first and second support assemblies are operated in their clamped configurations such that the first stabilizing surfaces engage the front surface of the parapet and the second stabilizing surfaces engage the rear surface of the parapet to clamp the parapet between the first and second stabilizing surfaces such that the first and second support assemblies support the operator engaging member at a first desired location relative to the exterior wall of the building; and to move the operator engaging member to a second desired location relative to the exterior wall of the building, the lever assembly of the first support assembly is operated to place second frame assembly of the first support assembly in its unclamped configuration while the second support assembly supports the operator engaging member to allow the first support assembly to be moved relative to the parapet, and the lever assembly of the second support assembly is operated to place the second frame assembly of the second support assembly in its unclamped configuration while the first support assembly supports the operator engaging member to allow the second support assembly to be moved relative to the parapet.

2. A suspension system as recited in claim 1, in which:

the lever assembly comprises a lever; and the lever is operatively connected to the second stabilizing surface such that movement of the lever displaces the second stabilizing surface from an unclamped position corresponding to the unclamped configuration to a clamped position corresponding to the clamped configuration.

3. A suspension system as recited in claim 2, further comprising a linkage assembly arranged to lock the lever in the clamped position but allow the lever to be moved into the unclamped position by selective application of manual force.

4. A suspension system as recited in claim 1, in which the first and second support assemblies each define at least one guide surface that respectively engages the first or second support line.

5. A suspension system as recited in claim 1, in which the first and second support assemblies each define at least one engaging surface that engages the upper surface of the parapet.

6. A suspension system as recited in claim 1, in which: the first and second support assemblies each define at least one guide surface that respectively engages the first or second support line; and the first and second support assemblies each define at least one engaging surface that engages the upper surface of the parapet.

7. A method of supporting an operator from a parapet of a building, the method comprising the steps of:

providing first and second support assemblies, where each of the support assemblies comprises a first frame assembly defining a first stabilizing surface, and a second frame assembly defining a second stabilizing surface and comprising a lever assembly operable to place the second frame assembly in clamped and unclamped configurations, the first frame assembly is releasably securable relative to the second frame assembly to allow a gross distance between the first and second stabilizing surfaces to be adjusted, as the lever assembly is moved into the clamped configuration, the lever assembly displaces the second stabilizing surface towards the first stabilizing surface, and as the lever assembly is moved into the unclamped configuration, the lever assembly displaces the second stabilizing surface away from the first stabilizing surface;

providing an operator engaging member configured to support the operator; supporting first and second support lines from the first and second support assemblies, respectively;

operatively connecting the first and second support lines to the operator engaging member;

releasably securing the first frame assemblies relative to the second frame assemblies of the first and second support assemblies, respectively, such that the gross distance between the first and second stabilizing surfaces is a desired distance determined based on a thickness dimension of the parapet between the front surface and the rear surface of the parapet;

with the gross distance adjusted to the desired distance, operating the lever assemblies of the first and second support assemblies in their clamped configurations such that the first stabilizing surfaces engage the front surface of the parapet and the second stabilizing surfaces engage the rear surface of the parapet to clamp the parapet between the first and second stabilizing surfaces such that the first and second support assemblies support the operator engaging member at a first desired location relative to the exterior wall of the building; and to move the operator engaging member to a second desired location relative to the exterior wall of the building, operating the lever assembly of the first support assembly to place the second frame assembly of the first support assembly in its unclamped configuration while the second support assembly supports the operator engaging member, moving the first support assembly relative to the parapet, operating the lever assembly of the first support assembly to place the second frame assembly of the first support assembly in its clamped configuration to secure the first support assembly to the parapet, and operating the lever assembly of the second support assembly to place second frame assembly of the second support assembly in its unclamped configuration while the first support assembly supports the operator engaging member, moving the second support assembly relative to the parapet, and operating the lever assembly of the second support assembly to place the second frame assembly of the second support assembly in its clamped configuration to secure the second support assembly to the parapet.

8. A method as recited in claim 7, in which the step of providing the lever assembly of the second support assembly comprises the step of operatively connecting a lever to the second engaging portion, the method further comprising the step of moving the lever to displace the second engaging portion from from an unclamped position corresponding to the unclamped configuration to a clamped position corresponding to the clamped configuration.

9. A method as recited in claim 8, the step of providing the lever assembly further comprising the step of arranging a linkage assembly to lock the lever in a clamped position but allow the lever to be moved into the unclamped positions by selective application of manual force.

10. A method as recited in claim 7, in which the first and second support assemblies each define at least one guide surface that respectively engages the first or second support line.

11. A method as recited in claim 7, in which the first and second support assemblies each define at least one engaging surface that engages the upper surface of the parapet.

12. A method as recited in claim 7, in which:

the first and second support assemblies each define at least one guide surface that engages the support line; and the first and second support assemblies each define at least one engaging surface that engages the upper surface of the parapet.

13. A support assembly for supporting a support line operatively connected to an operator engaging member adapted to support an operator from a parapet of a building, the parapet defining an upper surface, a front surface adjacent to the exterior wall of the building, and a rear surface, the support assembly comprising:

a first frame assembly defining a first stabilizing surface adapted to engage the front surface of the parapet;

a second frame assembly defining a second stabilizing surface adapted to engage the rear surface of the parapet and comprising a lever assembly operable to place the second frame assembly in clamped and unclamped configurations, the lever assembly comprising an engaging assembly comprising an engaging support and an engaging rod movably supported by the engaging support;

at least one of the first frame assembly and the second frame assembly defines a guide surface adapted to engage the support line; and at least one of the first frame assembly and the second frame assembly defines an engaging surface adapted to engage the upper surface of the parapet; whereby with the lever assembly in the clamped configuration, the first frame assembly is releasably secured relative to the second frame assembly to allow gross adjustment of a distance between the first and second stabilizing surfaces based on a thickness dimension of the parapet between the front surface and the rear surface of the parapet;

with the lever assembly in the clamped configuration, the engaging rod of the engaging assembly is arranged relative to the engaging support to allow fine adjustment of the distance between the first and second stabilizing surfaces based on the thickness dimension of the parapet;

with the distance adjusted, the at least one engaging surface engages the upper surface of the parapet and the lever assembly is arranged into the clamped configuration to displace the second stabilizing surface such that the first stabilizing surface engages the front surface of the parapet and the second stabilizing surface engages the rear surface of the parapet to clamp the parapet between the first and second stabilizing surfaces to secure the support assembly to the parapet and thus support the operator engaging member at a first desired location relative to the exterior wall of the building the lever assembly is operable into the unclamped configuration to displace the second stabilizing surface such that the first stabilizing surface is disengaged from the front surface of the parapet and the second stabilizing surface is disengaged from the rear surface of the parapet to allow movement of the first and second stabilizing surfaces relative to the parapet and thereby allow the operator engaging member to be moved to a second desired location relative to the exterior wall of the building; and the guide surface of at least one of the first frame assembly and the second frame assembly is adapted to engage the support line when the support line supports the operator engaging member such that the support line may move relative to the guide surface when the operator engaging member moves relative to the exterior wall of the building.

14. A support assembly as recited in claim 13, in which: the lever assembly comprises a lever; and the lever is operatively connected to a second engaging portion such that movement of the lever displaces the second engaging portion from an unclamped position corresponding to the unclamped configuration to a clamped position corresponding to the clamped configuration.

15. A support assembly as recited in claim 14, further comprising a linkage assembly arrange to lock the lever in the clamped position but allow the lever to be moved into the unclamped position by selective application of manual force.

* * * * *